US009728841B2

(12) United States Patent
Liou et al.

(10) Patent No.: US 9,728,841 B2
(45) Date of Patent: Aug. 8, 2017

(54) ANTENNA STRUCTURE AND WIRELESS COMMUNICATION DEVICE USING THE ANTENNA STRUCTURE

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 186 days.

(21) Appl. No.: 14/496,744

(22) Filed: Sep. 25, 2014

(65) Prior Publication Data

US 2015/0188211 A1 Jul. 2, 2015

(30) Foreign Application Priority Data

Dec. 31, 2013 (CN) ..... 2013 1 0748981

(51) Int. Cl.
*H01Q 1/24* (2006.01)
*H01Q 5/371* (2015.01)

(52) U.S. Cl.
CPC ..... *H01Q 1/243* (2013.01); *H01Q 5/371* (2015.01)

(58) Field of Classification Search
CPC ..... H01Q 5/371; H01Q 1/243; H01Q 21/30; H01Q 1/48
USPC ..... 343/702, 700 MS, 893
See application file for complete search history.

(56) References Cited

U.S. PATENT DOCUMENTS

2013/0135157 A1* 5/2013 Tsou ..... H01Q 1/2266 343/702

FOREIGN PATENT DOCUMENTS

CN 103078176 A 5/2013
TW M453978 5/2013

* cited by examiner

*Primary Examiner* — Jessica Han
*Assistant Examiner* — Jae Kim
(74) *Attorney, Agent, or Firm* — Steven Reiss

(57) ABSTRACT

An antenna structure includes a metal member, a radiating portion, a coupling portion, and a connecting portion. The metal member is grounded. The coupling portion is spaced apart from the radiating portion. The connecting portion has a first end electronically connected to the coupling portion and a second end electronically connected to the metal member. The radiating portion is configured to deliver current to the coupling portion.

11 Claims, 3 Drawing Sheets

ANTENNA STRUCTURE AND WIRELESS COMMUNICATION DEVICE USING THE ANTENNA STRUCTURE

FIELD

The subject matter herein generally relates to an antenna structure and a wireless communication device using the antenna structure.

BACKGROUND

Antennas are important elements of wireless communication devices, such as mobile phones or personal digital assistants. Many wireless communication devices further employ metal housings for improving heat dissipation or other purposes.

BRIEF DESCRIPTION OF THE DRAWINGS

Implementations of the present technology will now be described, by way of example only, with reference to the attached figures.

DETAILED DESCRIPTION

Figure 1:
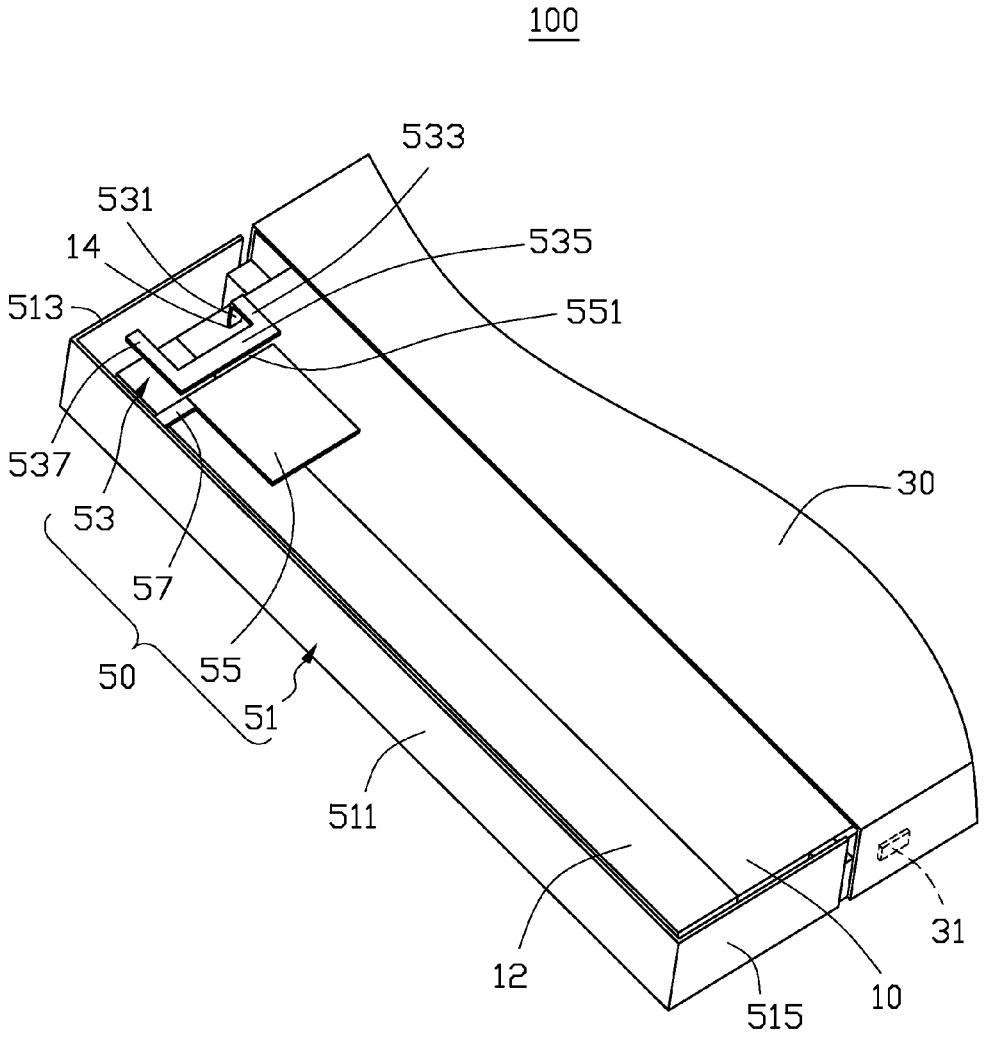
FIG. 1 is an isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wireless communication device 100. The wireless communication device 100 may be a mobile phone or a personal digital assistant, for example. The wireless communication device 100 includes a circuit board 10, a housing 30, and an antenna structure 50. The circuit board 10 includes a keep-out-zone

12 and a feed terminal 14. In this embodiment, the keep-out-zone 12 is formed in a side of the circuit board 10. The purpose of the keep-out-zone 12 is to prevent other electronic elements (such as a battery, a vibrator, a speaker, a Charge Coupled Device, etc.) from being placed in a predetermined area where it may interfere with the antenna structure 50. The feed terminal 14 is adjacent to the keep-out-zone 12 and is configured to provide current to the antenna structure 50.

The housing 30 is covered on an outside of the circuit board 10. At least one connecting elements 31 is protruded on an interior surface of the housing 30 and is configured to electronically connected to a ground terminal (not shown) of the circuit board 10.

The antenna structure 50 is configured to receive and/or send wireless signals and includes a metal member 51, a radiating portion 53, a coupling portion 55, and a connecting portion 57. The metal member 51 may be a part of a metal housing of the wireless communication device 100. In this embodiment, the metal member 51 includes a sidewall 511, a first end wall 513, and a second end wall 515. The sidewall 511 is spaced apart from and parallel to the circuit board 10. The first end wall 513 and the second end wall 515 are both positioned between the sidewall 511 and the housing 30. In this embodiment, the first end wall 513 and the second end wall 515 are parallel to each other and are respectively connected to two opposite ends of the sidewall 511, to jointly form a U-shaped structure. In this embodiment, ends of the first end wall 513 and the second end wall 515 away from the sidewall 511 are spaced apart from the housing 30. The first end wall 513 and the second end wall 515 are electronically connected to the housing 30 through shrapnel, probe, or other means, and are electronically connected to the ground terminal through the connecting element 31 to ground the metal member 51.

The radiating portion 53, the coupling portion 55, and the connecting portion 57 are all received in the U-shaped structure formed by the metal member 51. The radiating portion 53 is a monopole, and includes a feed section 531, a first radiating section 533, a second radiating section 535, and a third radiating section 537. The feed section 531 is a substantially rectangular sheet and is positioned in a plane substantially perpendicular to a plane in which the circuit board 10 is positioned. The feed section 531 is electronically connected to the feed terminal 14 of the circuit board 10 to feed current to the radiating portion 53. The first radiating section 533 is positioned in a plane substantially parallel to a plane in which the circuit board 10 is positioned. The second radiating section 535 and the third radiating section 537 are coplanar with the first radiating section 533.

The first radiating section 533, the second radiating section 535, and the third radiating section 537 cooperatively form a U-shape structure. In detail, the first radiating section 533 is a substantially rectangular sheet. The first radiating section 533 is perpendicularly connected to an end of the feed section 531 away from the feed terminal 14. The second radiating section 535 has a first end perpendicularly connected to an end of the first radiating section 533 away from the feed section 531 and a second end perpendicularly connected to the third radiating section 537. In this embodiment, the second radiating section 535 is partially positioned above the keep-out-zone 12. The third radiating section 537 is positioned above the keep-out-zone 12. The first radiating section 533 and the third radiating section 537 are both parallel to the sidewall 511. The second radiating section 535 is parallel to the first end wall 513 and the second end wall 515. In addition, the first radiating portion 53 is served as a first antenna of the antenna structure 50 to obtain a first working mode for receiving and/or transmitting high-frequency signals.

The coupling portion 55 is a substantially rectangular sheet and is partially positioned above the keep-out-zone 12. A width of the coupling portion 55 is substantially equal to a length of the second radiating section 535. The coupling portion 55 is positioned on a side of the second radiating section 535 away from the first radiating section 533 at a location different from the first radiating section 533, and spaced apart from the second radiating section 535. A gap 551 is defined between the coupling portion 55 and the second radiating section 535. In this embodiment, a width of the gap 535 is about 0.5 mm.

The connecting portion 57 is a substantially strip. A first end of the connecting portion 57 is electronically connected to the coupling portion 55. A second end of the connecting portion 57 is directly connected to the sidewall 511 or electronically connected to the sidewall 511 through probe, shrapnel or other means. In this embodiment, the connecting portion 57 is positioned above the keep-out-zone 12 and is substantially parallel to the first end wall 513 and the second end wall 515. The coupling portion 55, the connecting portion 57, and the metal member 51 are cooperatively served a second antenna of the antenna structure 50 to obtain a second working mode for receiving and/or transmitting low-frequency signals.

When current is input to the antenna structure 50 via the feed terminal 14, due to a distance between the second radiating section 535 and the coupling portion 55 satisfy requirements of the antenna structure 50, a portion of the current flows through the radiating portion 53 to form a first current path, thereby obtaining a high-frequency mode. A second portion of the current is coupled to the coupling portion 55, and is further grounded through the connecting portion 57, the metal member 51, and the connecting elements 31 to form a second current path, thereby obtaining a low-frequency mode. In this embodiment, the low-frequency mode has a central frequency of about 1575 megaHertz (MHz). The high-frequency mode has a frequency band of about 2400-2480 MHz.

Figure 2:
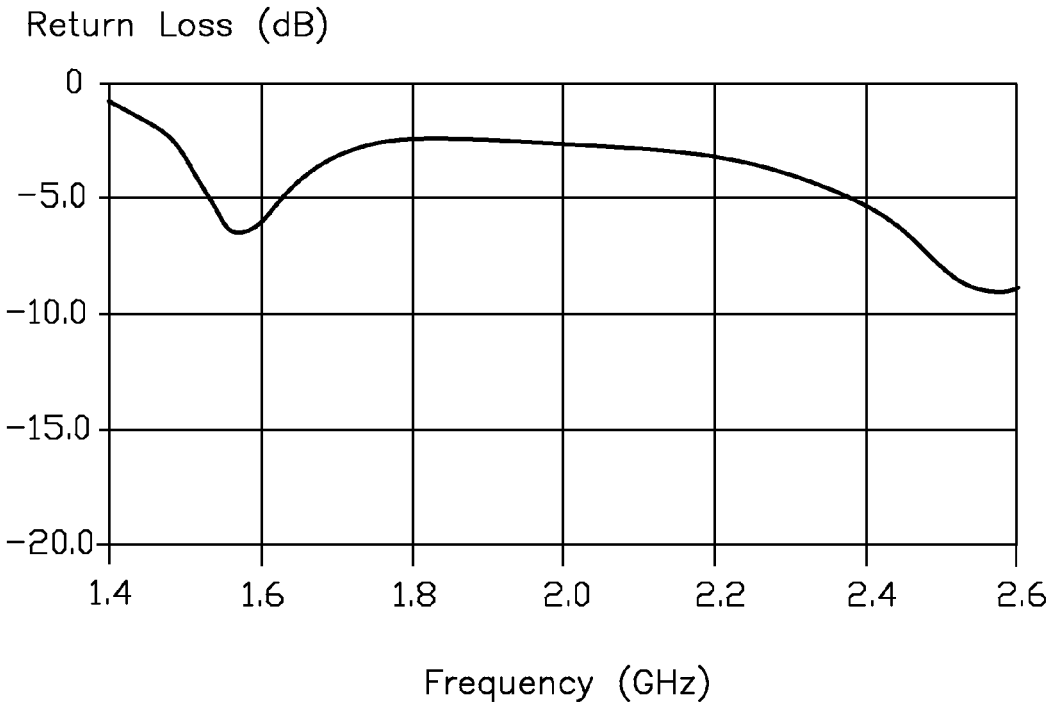
FIG. 2 is a return loss (RL) graph of the antenna structure of the wireless communication device of FIG. 1.

FIG. 2 is a return loss (RL) graph of the antenna structure 50. The antenna structure 50 has a good performance when operating at a frequency band of about 2400-2480 MHz and a central frequency of about 1575 MHz, and satisfies radiation requirements.

Figure 3:
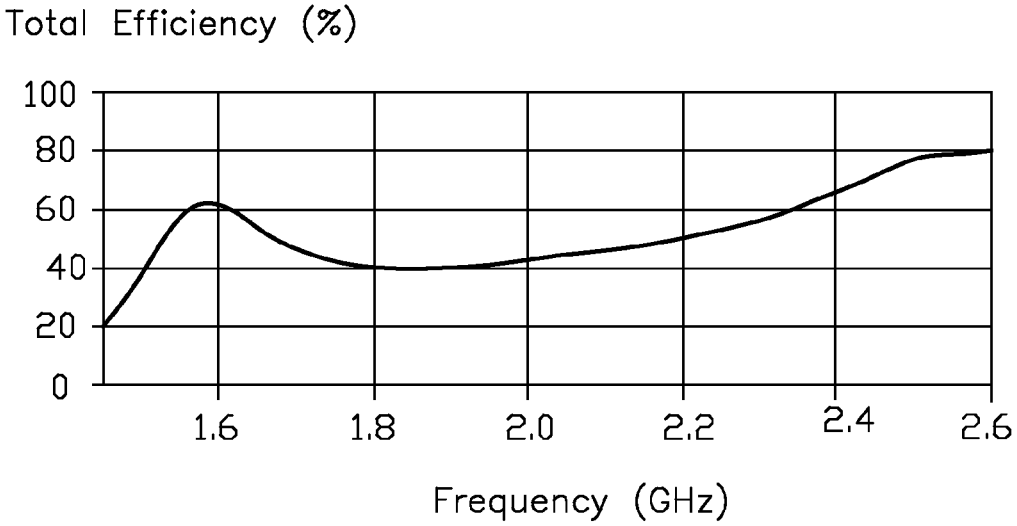
FIG. 3 is a radiating efficiency graph of the antenna structure of the wireless communication device of FIG. 1.

FIG. 3 is a radiating efficiency graph of the antenna structure 50. When the antenna structure 50 works at a central frequency of about 1575 MHz, a radiating efficiency of the antenna structure 50 is about 61.3%. When the antenna structure 50 works at a frequency band of about 2400-2480 MHz, radiating efficiencies of the antenna structure 50 are about 65%-75%, which are both acceptable and satisfy radiation requirements.

In other embodiments, the feed terminal 14 can be electronically connected to the radiating portion 53 through a filter to prevent interference between the first antenna and the second antenna.

In other embodiments, the metal member 51 can be directly connected to the housing 30. That is, there is no gap among the first end wall 513, the second end wall 513, and the housing 30.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure, comprising:

a grounded metal member;

a radiating portion comprising a substantially strip shaped feed section, a first substantially strip shaped radiating section, a second substantially strip shaped radiating section, and a third substantially strip shaped radiating section, wherein the first, second, and third radiating sections are coplanar and cooperatively form a U-shape structure; an end of the first radiating section is perpendicularly connected to an end of the feed section, the second radiating section has a first end perpendicularly connected to the other end of the first radiating section and a second end perpendicularly connected to the third radiating section;

wherein the metal member comprises a sidewall, a first end wall, and a second end wall, wherein the first end wall and the second end wall are parallel to each other and connect respectively to opposite ends of the sidewall to jointly form a U-shaped structure;

an electromagnetically coupled coupling portion coplanar and defining a gap with the second radiating section, wherein the coupling portion is a substantially rectangular sheet; and a connecting portion having a first end electronically connected to the coupling portion and a second end electronically connected to the sidewall, wherein the radiating portion, the coupling portion, and the connecting portion are all received in the U-shaped structure formed by the metal member.

2. The antenna structure of claim 1, wherein the radiating portion is monopole.

3. The antenna structure of claim 1, wherein the first radiating section and the third radiating section are both parallel to the sidewall, and the second radiating section is parallel to the first end wall and the second end wall.

4. The antenna structure of claim 1, wherein the coupling portion is positioned on a side of the second radiating section and is spaced apart from the second radiating section to define the gap between the coupling portion and the second radiating section.

5. The antenna structure of claim 4, wherein when the current is input to the antenna structure through the feed section, a portion of the current flows through the radiating portion, and the radiating portion serves as a first antenna of the antenna structure to receive and/or transmit first signals; a second portion of the current flows to the coupling portion and is further grounded through the coupling portion, the connecting portion, and the metal member, and wherein the coupling portion, the connecting portion, and the metal member serve as a second antenna of the antenna structure to receive and/or transmit second signals.

6. A wireless communication device, comprising:

a circuit board comprising a feed terminal; and an antenna structure, the antenna structure comprising: a grounded metal member;

a radiating portion electronically connected to the feed terminal and comprising a substantially strip shaped feed section, a first substantially strip shaped radiating section, a second substantially strip shaped radiating section, and a third substantially strip shaped radiating section, wherein the first, second, and third radiating sections are coplanar and cooperatively form a U-shape structure; an end of the first radiating section is perpendicularly connected to an end of the feed section, the second radiating section has a first end perpendicularly connected to the other end of the first radiating section and a second end perpendicularly connected to the third radiating section;

wherein the metal member comprises a sidewall, a first end wall, and a second end wall, wherein the first end wall and the second end wall are parallel to each other and connect respectively to opposite ends of the sidewall to jointly form a U-shaped structure;

an electromagnetically coupled coupling portion coplanar and defining a aap with the second radiating section, wherein the coupling portion is a substantially rectangular sheet; and a connecting portion electronically connected between the coupling portion and the sidewall, wherein the radiating portion, the coupling portion, and the connecting portion are all received in the U-shaped structure formed by the metal member.

7. The wireless communication device of claim 6, further comprising a housing, wherein the housing comprises at least one connecting element, wherein the metal member is electronically connected to the housing and grounded through the at least one connecting element.

8. The wireless communication device of claim 6, wherein the radiating portion is monopole.

9. The wireless communication device of claim 6, wherein the first radiating section and the third radiating section are both parallel to the sidewall, and the second radiating section is parallel to the first end wall and the second end wall.

10. The wireless communication device of claim 6, wherein the coupling portion is positioned on a side of the second radiating section and is spaced apart from the second radiating section to define the gap between the coupling portion and the second radiating section.

11. The wireless communication device of claim 10, wherein when the current is input to the antenna structure through the feed section, a portion of the current flows through the radiating portion, and the radiating portion serves as a first antenna of the antenna structure to receive and/or transmit first signals; a second portion of the current flows to the coupling portion and is further grounded through the coupling portion, the connecting portion, and the metal member, and wherein the coupling portion, the connecting portion, and the metal member serve as a second antenna of the antenna structure to receive and/or transmit second signals.

* * * * *